US006370216B1

(12) United States Patent
Lawandy et al.

(10) Patent No.: US 6,370,216 B1
(45) Date of Patent: Apr. 9, 2002

(54) THICKNESS SENSOR SUITABLE FOR DETECTING A PRESENCE OF A PLURALITY OF ITEMS, SUCH AS CURRENCY

(75) Inventors: Nabil M. Lawandy, North Kingstown; John Moon, Cumberland, both of RI (US)

(73) Assignee: Spectra Science Corporation, Providence, RI (US)

( * ) Notice: Subject to any disclaimer, the term of this patent is extended or adjusted under 35 U.S.C. 154(b) by 0 days.

(21) Appl. No.: 09/535,921

(22) Filed: Mar. 24, 2000

Related U.S. Application Data

(60) Provisional application No. 60/126,992, filed on Mar. 30, 1999.

(51) Int. Cl.[7] ..... G06M 11/00
(52) U.S. Cl. ..... 377/8; 377/6; 377/10
(58) Field of Search ..... 377/6, 8, 10

(56) References Cited

U.S. PATENT DOCUMENTS 4,703,172 A 10/1987 Sherman, III et al. ..... 250/223
4,723,072 A 2/1988 Naruse ..... 235/454
4,761,002 A 8/1988 Reed et al. ..... 271/111
4,875,589 A 10/1989 Lacey et al. ..... 209/534
6,012,565 A * 1/2000 Mazur ..... 194/207
6,242,733 B1 * 6/2001 Ma et al. ..... 250/223 R

FOREIGN PATENT DOCUMENTS

WO WO 91/03031 3/1991 ..... G07D/7/00

OTHER PUBLICATIONS

Newspaper Article entitled: "In Vending Machine, Brains That Tell Good Money From Bad", New York Times, Apr. 8, 1999.

* cited by examiner

*Primary Examiner*—Margaret R. Wambach
(74) *Attorney, Agent, or Firm*—Harrington & Smith, LLP

(57) ABSTRACT

A method and system for detecting a presence of more than one item at a point along a conveyance path, comprising steps of (A) generating a light beam and directing the beam through the path such that a presence of the item will cause the beam to be attenuated; (B) detecting the beam after it is attenuated by the presence of the item; and (C) determining from the amount of attenuation how many items are simultaneously present. In the preferred embodiment the item is an item of currency, and the step of generating a light beam includes a step of operating an optical source, such as an LED or a laser, to generate a beam having a wavelength in the range of about 400 nm to about 1 micrometer or longer.

16 Claims, 3 Drawing Sheets

THICKNESS SENSOR SUITABLE FOR DETECTING A PRESENCE OF A PLURALITY OF ITEMS, SUCH AS CURRENCY

CLAIM OF PRIORITY FROM A COPENDING PROVISIONAL PATENT APPLICATION

Priority is herewith claimed under 35 U.S.C. §119 (e) from copending Provisional Patent Application 60/126,992, filed Mar. 30, 1999, entitled "THICKNESS SENSOR SUITABLE FOR DETECTING A PRESENCE OF A PLURALITY OF ITEMS, SUCH AS CURRENCY", by Nabil M. Lawandy and John Moon. The disclosure of this Provisional Patent Application is incorporated by reference herein in its entirety.

FIELD OF THE INVENTION

This invention relates generally to methods and apparatus for conveying, sorting and counting items characterized by having a thin paper or paper-like substrate, such as currency.

BACKGROUND OF THE INVENTION

High speed mechanical conveyors of currency typically include some type of mechanism for counting or otherwise recording a number of notes that pass a certain point. For example, if it is desired to accurately count the notes as they pass a certain point, or after they pass the certain point, and if the counting mechanism assumes that only one note is present at a time, then if a plurality of notes are "stuck-together" or otherwise attached to one another the count will not be accurate. To avoid this problem one may provide some type of device for detecting if more than one note is present. However, due to the typical high velocity at which the notes pass a given point, the detecting device must operate accurately in a high speed, preferably non-contact manner, while avoiding the generation of "false alarm" indications that may result in the operation of the conveyor system being halted, slowed, or otherwise altered.

OBJECTS OF THE INVENTION

It is a first object of this invention to provide an improved technique to detect a presence of more than one item at a particular point along a path through an item conveyor or transport system.

It is a further object of this invention to provide a high speed, non-contact sensor that is capable of detecting a thickness of a substrate, such as a currency substrate, and for indicating a number of substrates that are present at a particular point along a path through a currency conveyor system.

SUMMARY OF THE INVENTION

The foregoing and other problems are overcome and the objects of the invention are realized by methods and apparatus in accordance with embodiments of this invention.

Disclosed is a method and system for detecting a presence of more than one item at a point along a conveyance path, comprising steps of (A) generating a light beam and directing the beam through the path such that a presence of the item will cause the beam to be attenuated; (B) detecting the beam after it is attenuated by the presence of the item; and (C) determining from the amount of attenuation how many items are simultaneously present. In the preferred embodiment the item is an item of currency, and the step of generating a light beam includes a step of operating an optical source, such as a LED or a laser, to generate a beam having a wavelength in the range of about 400 nm to about 1 micrometer or longer.

The method can further include a step of detecting light that reflects from the item of currency to determine at least one characteristic of the item of currency, such as an amount of soiling.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
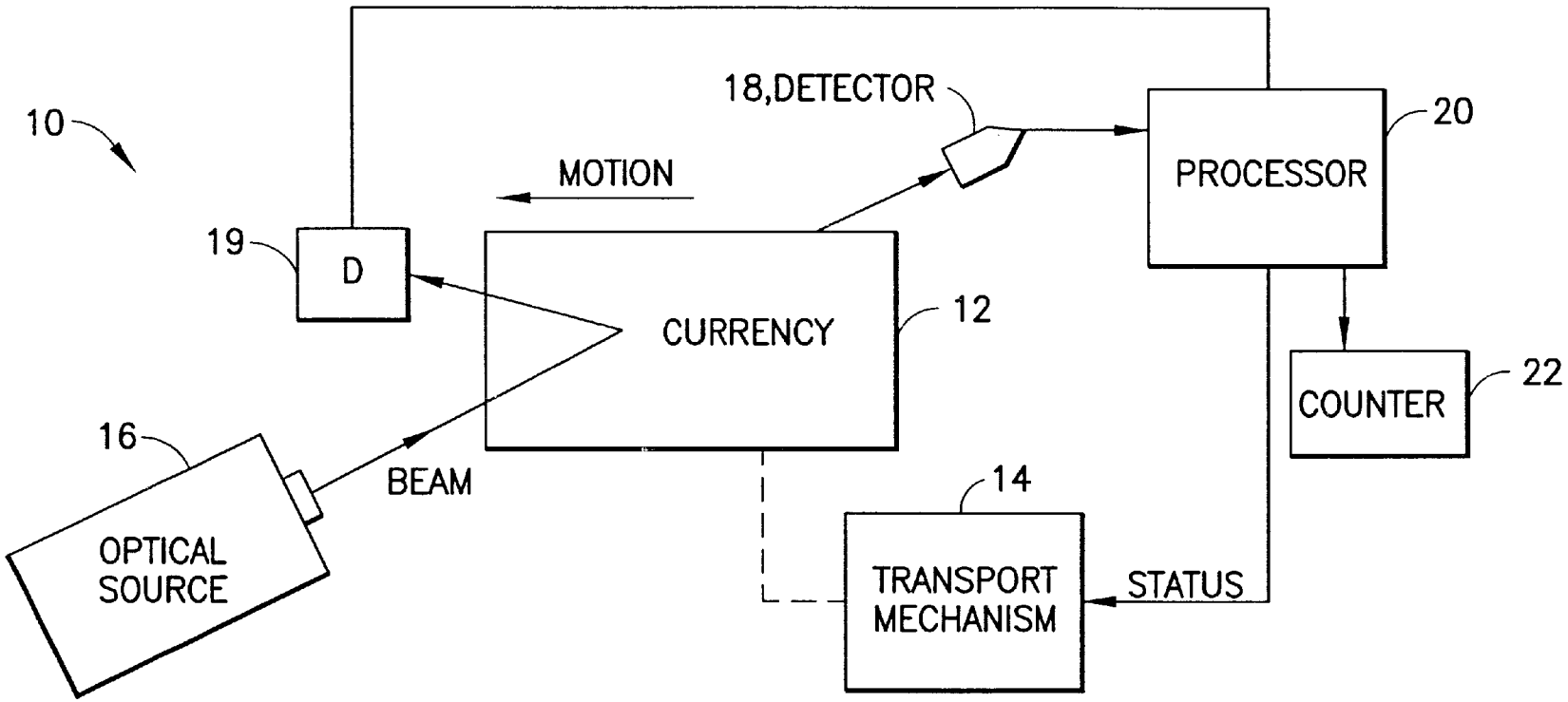
FIG. 1 is a simplified block diagram that illustrates an item of currency being conveyed past a particular point whereat an optically-based currency thickness sensor is stationed, the sensor including an optical source that generates an output beam, an optical detector, and a processor capable of determining from the output of the detector an amount of attenuation experienced by the beam as it passes through the currency.

Reference is made to FIG. 1 for illustrating a simplified block diagram of a currency conveyance or transport system 10 wherein an item of currency 12 is being conveyed past a particular point. A transport mechanism 14 can include driven rollers and the like for moving the item of currency 12 in the direction of the arrow. In accordance with this invention an optically-based currency thickness sensor is stationed at the particular point. The sensor includes at least one optical light source 16, which could be at least one laser source that generates at least one laser beam that is aimed so that the item of currency 12 passes through the beam. On the opposite side of the item of currency is at least one optical detector 18 having an output coupled to a processor 20. The processor 20 is capable of determining from the output of the detector 18 an amount of attenuation experienced by the laser beam as it passes through the item of currency. A physical and/or a logical counter 22 can be provided so as indicate a current count of items of currency 12 that pass through the laser beam.

The teachings of this invention are not limited to the use of laser sources, such as frequency doubled YAG lasers or semiconductor, solid state lasers, but could employ other light sources, such as a strobe light or, more preferably, one or more light emitting diodes (LEDs).

Figure 2:
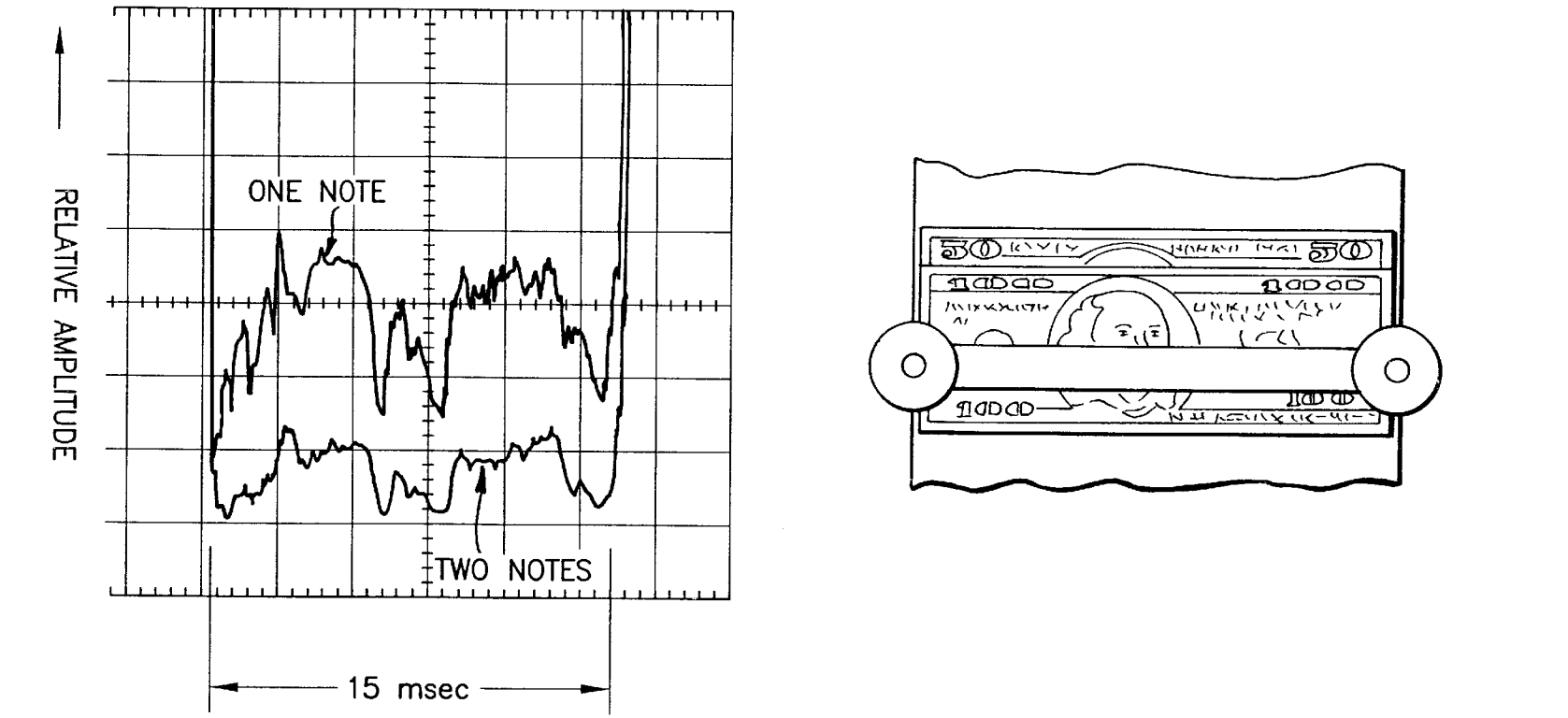
FIG. 2 is a graph depicting the relative beam detected amplitude plotted as a function of time for a normal, one note case, and for a two note case.
Figure 3:
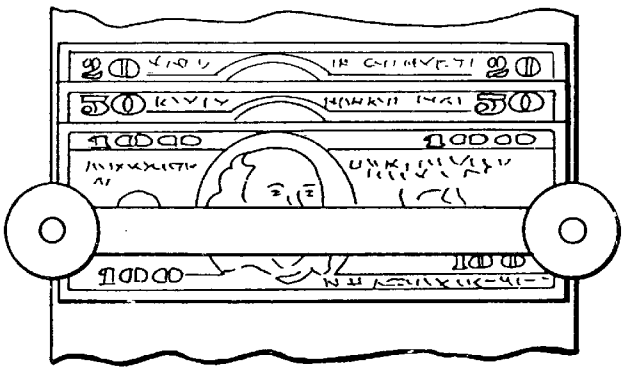
FIG. 3 is a graph depicting the relative beam detected amplitude plotted as a function of time for the normal, one note case, for the two note case, as in FIG. 2, and also for a three note case.
Figure 3:
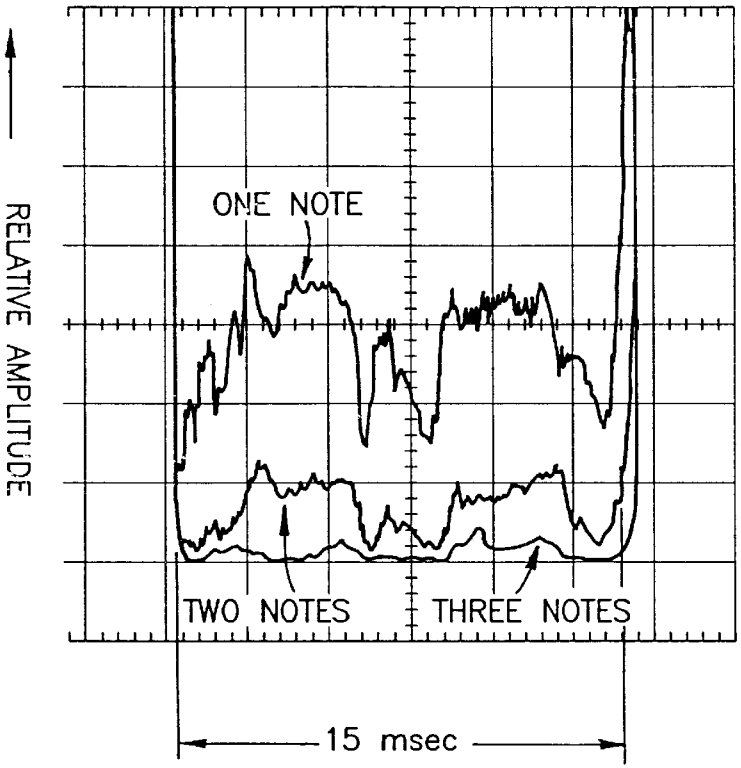

Referring now also to FIGS. 2 and 3, the relative amplitude of the detector 18 output signal can be seen to be a maximum before and after the passage of the item of currency 12 (which is assumed in an exemplary, presently preferred high speed conveyance system to require about 15 milliseconds) . While the item of currency 12 is passing through the laser beam some portion of the beam is absorbed and, as a result, the output of detector 18 falls to a lower value. It can be seen readily seen that there is a significant and measurable difference between the amount of laser beam attenuation for the one note case, as opposed to the two note case (FIGS. 2 and 3) and the three note case (FIG. 3).

The processor 20 can be arranged to provide a Status signal to the transport mechanism 14 for indicating, for example, when the output of the detector 18 indicates that more than one item of currency 12 is simultaneously present in the laser beam. The transport mechanism 14 may then stop the conveyor of the currency, or may operate a diverter for removing the multiple items of currency, or may perform any other suitable response to the indication that more than one item of currency is found to be simultaneously present in the laser beam.

Further in this regard, in a counting application, and if the output of the detector 18 has a magnitude that corresponds to the simultaneous presence of two items of currency 12 (or three items of currency, etc.), then the counter 22 can be incremented by the sensed number of items of currency, without stopping the transport mechanism 14 or operating a diverter. For example, of the counter 22 has a value of 78, and if the output of the detector 18 has a magnitude that corresponds to the simultaneous presence of two items of currency 12, then the counter 22 is incremented by two to become 80, and the operation of the transport mechanism 14 is not interrupted.

The optical source 16 may be a commercially available diode laser (or a LED) having an output wavelength in the range of about 400 nm to about one micrometer (or longer), and the detector 18 may be any suitable silicon-based or other type of detector that is responsive to the output light from the optical source 16. One presently preferred wavelength is about 670 nm. A wavelength of less than 400 nm may be too strongly absorbed to be of practical use, while a wavelength of significantly more than one micrometer may complicate the generation and/or detection of the optical signal. The optical source 16 may be operated in a continuous wave (CW) mode, or intermittently in a pulsed mode.

The optically-based currency thickness sensor in accordance with the teaching of this invention may be used alone or in combination with other types of systems for detecting a presence of more than one item of currency.

The optically-based currency thickness sensor in accordance with the teaching of this invention may be used to detect the length of, and the relative longitudinal orientations of, the items of currency as they pass the predetermined point. For example, if it is assumed that the laser beam will be attenuated for about 15 milliseconds by a normal sized item of currency having a particular orientation, when moving at the characteristic velocity of the conveyor mechanism, then any significant deviation from the 15 millisecond attenuation time, assuming that the velocity is within specifications, will be indicative of some problem with the length of or the orientation of the item of currency 12.

This technique can thus also be used to detect the simultaneous presence of more than one item of currency, if it is assumed that the two or more items of currency are not exactly aligned edge to edge as they pass through region between the optical source(s) and the detector(s). In this case it can also be realized that the amount of attenuation of the light beam can be as much as 100%, as it is the duration of the measured attenuation (for example, some time greater than the time associated with one item of currency travelling at the nominal speed of the transport mechanism 14 (e.g., 15 milliseconds)) that is of most significance, and not the actual amount of attenuation.

It should be realized that the two techniques can be used together. For example, a detected decrease in the amount of transmitted light through an item of currency 12 is indicative of the simultaneous presence of two or more items of currency, and this condition can be verified by also determining if the duration of the attenuation exceeds the normal duration (e.g., 15 milliseconds). The opposite case can be employed as well, wherein a detected increase in the amount is employed to verify that a measured change in the duration of the attenuation was due to the presence of two or more items of currency, and was not due to detector noise or some fluctuation in the intensity of the optical source, etc.

Referring again to FIG. 1, the system can further include another optical detector (D) 19 disposed for detecting light that reflects from the item of currency 12. In this case the processor 20 has another input coupled to an output of the optical detector 19 for determining at least one characteristic of the item of currency 12. The at least one characteristic can be an amount of soiling, as less light will be reflected from a soiled note than from a clean note. Another characteristic could include the "newness" of the note, while another could include an amount of wrinkling of the note, while another could be related to whether the note is genuine or counterfeit. It is preferred that the output of the detector 19 be used in conjunction with the output of the detector 18, although either could be used alone.

While described in the context of items of currency, it should be appreciated that the teachings of this invention can be applied as well to bank check handling machines and other types of equipment where relatively thin substrate materials are moved individually, or in groups, along a desired path. That is, while in the presently preferred embodiment of this invention a normal, desirable case is one item of currency 12, in other embodiments the normal case may be two items of some substrate material, and the undesirable cases may be the presence of only one item, or the presence of three or more items. Referring again to FIG. 3, it can be seen that the thickness sensor in accordance with this invention can readily discriminate between these cases.

Thus, while the invention has been particularly shown and described with respect to preferred embodiments thereof, it will be understood by those skilled in the art that changes in form and details may be made therein without departing from the scope and spirit of the invention.

What is claimed is:

1. A method for detecting a presence of more than one item of currency passing a location along a conveyance path, comprising steps of:

generating a light beam and directing the beam through the path such that a presence of an item of currency causes the beam to be attenuated;

detecting the beam after it is attenuated by the presence of the item of currency; and determining if a duration of the attenuated beam corresponds to an expected duration based on a length of the item of currency and on a velocity at which the item of currency is expected to pass through the beam.

2. A method as in claim 1, wherein the step of determining includes a step of identifying a number of items of currency that are simultaneously present in the beam.

3. A method as in claim 1, wherein the step of generating a light beam includes a step of operating at least one optical source to generate at least one beam having a wavelength greater than about 400 nm.

4. A method as in claim 1, and further comprising a step of detecting light that reflects from the item of currency to determine at least one characteristic of the item of currency.

5. A method as in claim 4, wherein the at least one characteristic is an amount of soiling.

6. A system for counting currency, comprising:

a currency transport mechanism defining a conveyance path for currency;

at least one light source located along said conveyance path for directing a light beam across the conveyance path such that a presence of an item of currency causes the beam to be attenuated;

at least one optical detector for detecting the beam after it is attenuated by the presence of the item of currency; and a processor having an input coupled to an output of said optical detector for determining from an amount of attenuation a number of items of currency that are simultaneously present in the beam; and further comprising a further optical detector disposed for detecting light that reflects from the item of currency, and wherein said processor has another input coupled to an output of said further optical detector for determining at least one characteristic of the item of currency.

7. A system as in claim 6, and further comprising a counter having an input coupled to an output of said processor, said processor controlling said counter so as to increment a count of the items of currency in accordance with the determined number.

8. A system as in claim 6, wherein said at least one light source has an optical output with a wavelength greater than about 400 nm.

9. A system as in claim 6, wherein said at least one light source has an optical output with a wavelength in a range of about 400 nm to about 1000 nm.

10. A system as in claim 6, wherein said at least one light source has an optical output with a wavelength of about 670 nm.

11. A system as in claim 6, wherein the at least one characteristic is an amount of soiling.

12. Apparatus for detecting a presence of more than one item of currency passing a location along a conveyance path, comprising:

a source for generating a light beam and directing the light beam into the path such that a presence of an item of currency causes the beam to be attenuated;

a detector for detecting the beam after it is attenuated by the presence of the item of currency; and circuitry for determining if a duration of the attenuated beam corresponds to an expected duration based on a length of the item of currency and on a velocity at which the item of currency is expected to pass through the light beam.

13. Apparatus as in claim 12, wherein the circuitry is operable for identifying a number of items of currency that are simultaneously present in the light beam.

14. Apparatus as in claim 12, wherein the source comprises at least one optical source for generating at least one beam having a wavelength greater than about 400 nm.

15. Apparatus as in claim 12, and further comprising a further detector for detecting light that reflects from the item of currency for determining at least one characteristic of the item of currency.

16. Apparatus as in claim 15, wherein the at least one characteristic is an amount of soiling.

* * * * *